United States Patent [19]

Ebisawa et al.

[11] 4,297,024

[45] Oct. 27, 1981

[54] EXPOSURE DEVICE OF AN ELECTROGRAPHIC COPYING APPARATUS

[75] Inventors: Kiyohito Ebisawa, Tokyo; Satoshi Hisabayashi, Hachioji; Toshio Koike, Hachioji; Kazuyuki Hashimoto, Hachioji, all of Japan

[73] Assignee: Iwatsu Electric Co., Ltd., Tokyo, Japan

[21] Appl. No.: 32,345

[22] Filed: Apr. 23, 1979

[30] Foreign Application Priority Data

Apr. 25, 1978 [JP] Japan ..... 53-54166[U]
Apr. 25, 1978 [JP] Japan ..... 53-54167[U]
Apr. 25, 1978 [JP] Japan ..... 53-54168[U]

[51] Int. Cl.[3] ..... G03G 15/00
[52] U.S. Cl. ..... 355/14 E; 355/3 R; 355/69; 355/71
[58] Field of Search ..... 355/3 R, 14 R, 14 E, 355/68, 69, 71

[56] References Cited

U.S. PATENT DOCUMENTS

| | | | |
|---|---|---|---|
| 3,606,535 | 9/1971 | Koizumi | 355/66 |
| 3,771,867 | 11/1973 | Moser | 355/3 R X |
| 3,779,640 | 12/1973 | Kidd | 355/4 X |
| 3,948,586 | 4/1976 | Komori et al. | 355/14 R |
| 4,027,965 | 6/1977 | Mikasa et al. | 355/14 R X |
| 4,048,666 | 9/1977 | Irie et al. | 355/14 R X |
| 4,140,385 | 2/1979 | Shaw et al. | 355/3 R |
| 4,176,943 | 12/1979 | Hasebe | 355/14 R |

*Primary Examiner*—Fred L. Braun
*Attorney, Agent, or Firm*—Merchant, Gould, Smith, Edell, Welter & Schmidt

[57] ABSTRACT

An exposure device of an electrographic copying apparatus including at least one heat generative exposure lamp for exposing a photosensitive paper corresponding to an original to be copied. A paper detector detects the photosensitive paper at an inlet of the apparatus. A rotatable cam is actuated by a signal from the paper detector and, in turn, actuates a switching apparatus in a predetermined sequence during one revolution thereof. A relay is actuated by one of said switches so as to be self-latched for a predetermined time, to activate the exposure lamp for the predetermined time.

4 Claims, 8 Drawing Figures

EXPOSURE DEVICE OF AN ELECTROGRAPHIC COPYING APPARATUS

BACKGROUND OF THE INVENTION

The present invention relates to an electrographic copying apparatus, more particularly, it relates to improvements of an exposure device of the copying apparatus.

Various types of electrographic copying apparatus are presently used. However, conventional electrographic copying apparatuses have the following disadvantageous points in the exposure device thereof.

Firstly, the temperature of an exposure lamp is excessively increased if the lamp is lit accidentally for a long time. Such a problem is governed by a law directed to the control of electric apparatus in Japan. Various means have been applied for avoiding the increase of the temperature of the exposure lamp lit for a long time. One of the means is to cool the lamp by a cooling mechanism. Another means is to adjust the periodic duty of the lamp. Still another means is to reduce the electric power of the lamp. However, such conventional means do not avoid accidental or unintended lighting of the lamp caused by improper handling of the apparatus due to the carelessness of an operator. Therefore, there is a possibility of thermal damage to the apparatus elements due to the carelessness of an operator.

Secondly, there is a problem in how to control the exposure and adjust the uneveness of the exposure in order to get a clear copy. In the exposure device of an electrographic copying apparatus in which an original is exposed and scanned by moving an optical system or moving the original, a beam from an exposure lamp is reflected by the original on an original positioning plate of glass. The beam reflected by the original exposes a photosensitive paper corresponding to the image density of the original through the optical system. It is desirable to control the exposure in response to the speed of the photosensitive paper, developing capacity, or material of the original. Also, it is desirable to control the uneveness of the exposure, due to the uneveness of the brightness of the exposure lamp and/or the characteristic of a lens that the brightness of the light beam through the lens is darker in the periphery portion of the lens than in the center, so as to expose the paper evenly, corresponding to the image density of the original.

A conventional means for controlling the exposure and the uneveness of the exposure comprises a movable guide plate and a cover plate attached to the end of the guide plate. The passage of the exposure beam is defined by the movable guide plate and a fixed guide plate facing the movable guide plate. The cover plate shields a part of the area of the cross section of the beam passage. The exposure, i.e. the amount of light used to expose a photosensitive paper, is controlled by shifting the movable guide plate so as to change the width of the beam passage. The uneveness of the exposure is controlled by cutting the cover plate to form a desirable shape, so that the shape of the cross section of the beam passage is changed. The movable guide plate is attached to a body of the exposure device by a screw positioned on the front side of the body and by another screw positioned on the rear side of the body. In such a conventional control means, the position of the movable guide plate is adjusted both at the front side and at the rear side. Such an adjusting operation is very troublesome. That is, it is not easy to equally shift the guide plate both at the front and rear sides. In addition, the cover plate must be removed from the guide plate and taken out of the exposure device, when the cover plate is to be cut for controlling the uneveness of the exposure. Such a control operation is, also, very troublesome. Furthermore, it is very difficult to take the cover plate out of the exposure device, if the space around the copying apparatus is small.

The third problem is how to prevent a shade from being copied along an edge of an overlapped paper on an original. In the conventional copying apparatus, the exposure device is movably mounted between an original positioning plate and a photosensitive paper. If an original on which another original paper overlaps is exposed, shade appears along the edge of the overlapped paper due to its thickness. This unnecessary shade is copied on the photosensitive paper. Especially, in an electrographic photoengraving machine, the shade line is copied on a master plate. Such a shade line must be erased from the master plate before an etching process of the master plate. This operation is very troublesome.

SUMMARY OF THE INVENTION

It is a first object of the present invention to provide an electrographic copying apparatus in which the aforementioned first disadvantage is obviated by a means for controlling the exposure lamp so that it is turned on and off reliably, and that an excessive increase of the lamp temperature is prevented from occurring.

It is a second object of the present invention to provide an electrographic copying apparatus in which the aforementioned first and second disadvantages are obviated by a feature that it further comprises an improved means for controlling the exposure and for adjusting the uneveness of exposure, in addition to said lamp control means.

It is a third object of the present invention to provide an electrographic copying apparatus in which the aforementioned first and third disadvantages are obviated by a feature that it further comprises a means for removing an unnecessary shade line appearing around a paper overlapped on an original due to the thickness of the overlapped paper.

An exposure device of an electrographic copying apparatus according to the present invention, which comprises at least one heat generative exposure lamp for exposing a photosensitive paper corresponding to an original to be copied, is characterized in that it comprises: a paper detector means which detects said photosensitive paper at an inlet of the apparatus; a rotatable cam means which is actuated by a signal from said paper detector means and which actuates a plurality of switching means in a predetermined sequense during one revolution thereof, and; a relay means which is actuated by one of said switching means so as to be self-latched for a predetermined time, so that said exposure lamp is turned on for said predetermined time.

DETAILED EXPLANATION OF THE PREFERRED EMBODIMENTS

A lamp control means according to the present invention will now be described in detail with reference to FIGS. 1 through 4B.

Figure 1:
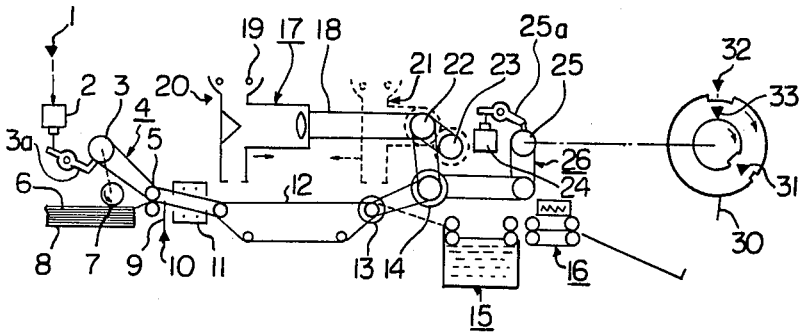
FIG. 1 is a schematic view which illustrate a construction of an embodiment of the present invention.

The construction and function of a wet type electrographic copying apparatus which comprises a lamp control means according to the present invention are as follows. Referring to FIG. 1, a plurality of sheets of photosensitive paper 6 are stacked in a paper box 8. The paper 6 is discharged out of the box 8 by a roller 7 which is actuated by a rotatable clutch 3. The paper 6 is, then, fed into a charging device 11 through feed rollers 5. The paper is transferred to an exposure position where the paper is kept stationary for an exposure time and is, then, transferred to a developing device 15 by a conveyor device 12. An exposure device 17, which is reciprocally mounted over the conveyor device 12, exposes the photosensitive paper 6 so as to form an electrostatic latent image on the paper 6 corresponding to an original. A heating device 16 dries the developed paper 6, which is then discharged out of the apparatus. The copying apparatus further comprises a means for controlling each operational device in sequence in response to the operational conditions of the other devices, which is described in detail later.

Figure 2:
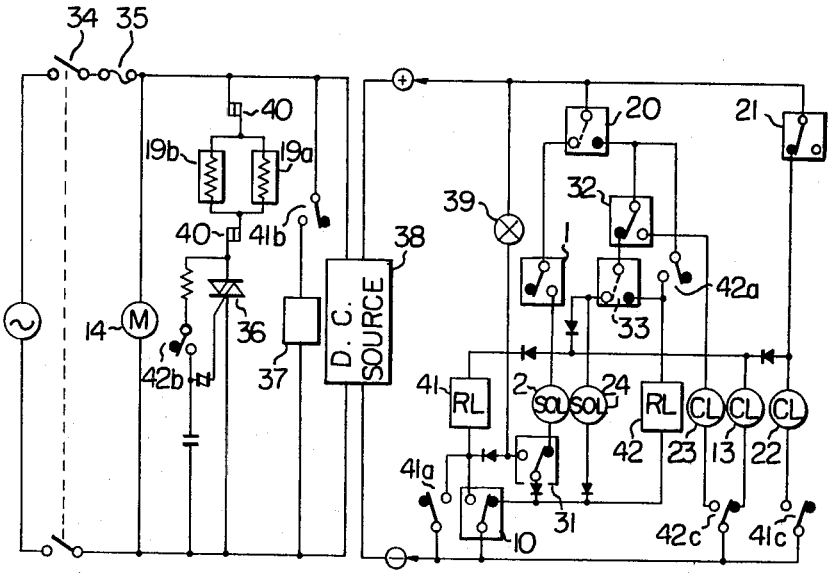
FIG. 2 illustrates a control circuit used in the apparatus illustrated in FIG. 1.

The operation of the exposure device 12 will be described hereinafter with reference to FIGS. 1, 2 and 3. When a power switch 34 is turned on, a drive motor 14 is supplied with electric power for rotation through a fuse 35, so that a paper feed device 4 (FIG. 1), the developing device 15, the heating device 16, and a cam drive means 26 (FIG. 1) are actuated. This operations are shown in the time charts (a), (d), (f), (g), (h) and (q) in FIG. 3. The conveyor device 12 is actuated by a transmission clutch 13 which is supplied with power from a DC source 38. This operation is shown in the time chart (m) in FIG. 3. When a start switch 1 is pushed on, a paper feed solenoid 2 is energized so as to disengage a hook 3*a* from the clutch 3 so that the rotation of the clutch 3 is transmitted to the roller 7, which discharges an uppermost photosensitive paper 6 out of the paper box 8. The above mentioned operations of the start switch 1 and the paper feed solenoid 2 are shown in the time charts (b) and (k) in FIG. 3. The paper 6 actuates a switch lever 9 arranged behind the feed rollers 5, so as to turn a paper detector switch 10 on, which lights a pilot lamp 39. A relay 41 is actuated by the switch 10, so that it is self-latched by a relay contact 41*a*, that another relay contact 41*b* is turned on so as to supply a high voltage power from a power source 37 to the charging device 11, so as to start a corona discharge operation, and that a further relay contact 41*c* actuates an optical mechanism driving clutch 22, so as to move the exposure device 17 through a driving wire 18. The timing relationship among the above mentioned operations can be seen from the time charts (c), (p), (i), and (n) in FIG. 3. After the exposure device 17 has started to move, a first exposure device detecting switch 20 is turned off as shown in the time chart (d) in FIG. 3. When the exposure device 17 has reached the end of its movement, a second exposure device detecting switch 21 is turned on, as shown in the time chart (e) in FIG. 3, so as to emit a stop signal for the movement of the exposure device 17. When the rear end of the paper 6 has passed over the switch lever 9, the paper detector switch 10 is turned off, as shown in the time chart (c) in FIG. 3, and a solenoid 24 is energized, as shown in the time chart (1) in FIG. 3, so that a hook 25*a* is disengaged from a rotatable clutch 25, so as to allow the rotation of the clutch 25 to be transmitted to a cam disc 30. The cam disc 30, then, actuates three switches 31 through 33 in a predetermined sequence, so as to emit three signals, as shown in the time charts (f), (g), (h), respectively, the functions of which signals are described hereinafter.

Figure 3:
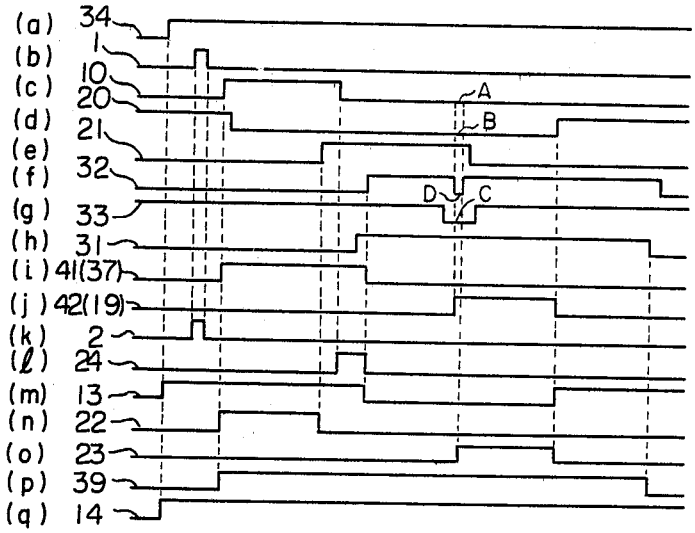
FIG. 3 is a time chart of each device of the apparatus according to the present invention.

As can be seen from the time charts (f), (g), (h) in FIG. 3, at first a first switch 31 for keeping the pilot lamp 39 turned on is turned on, then, a second switch 32 for stopping the paper movement is turned on. By a signal from the second switch 32 which has been turned on, the transmission clutch 13 is turned off, as shown in the time chart (m) in FIG. 3, so that the conveyor device 12 is stopped with the paper thereon. By the same signal from the second switch 32, the relay 41 is turned off. Therefore, the supply of power from the power source 37 to the discharging device 11 stops, and this stops the corona discharge operation. The exposure device 17 and the conveyor device 12 with the paper thereon are kept stationary for a period of time before the exposure operation starts, in which period the vibration of the exposure device 17 and the conveyor device 12 is attenuated, which vibration causes the blurring of a copy. When the cam disc 30 is further rotated, a third switch 33 is turned off, which switch 33 has been kept turned on since the start of rotation of the cam disc 30, as shown in the time chart (g) in FIG. 3. The cam disc 30 is so arranged that the second switch 32 is turned off, as shown by the line D in FIG. 3, in a period in which the third switch 33 is turned off (line C in FIG. 3), the paper detector switch 10 is turned off (line A in FIG. 3), and the first exposure device detecting switch 20 is turned off (line B in FIG. 3). This causes a relay 42 to be self-latched by a contact 42*a*. Exposure lamps 19 are turned on by a relay contact 42*b*, as shown in the time chart (j) in FIG. 3. When the cam disc 30 is further rotated after the lamps 19 are turned on, the second switch 32 is again turned on, as shown in the time chart (f) in FIG. 3. The interval from the time the switch 32 is turned off to the time it is turned on is arranged so as to correspond to the rise time of the luminous intensity of the exposure lamps 19 or, otherwise, it may be arranged so as to correspond to the time which is necessary for the relay 42 to be self-latched. When the second switch 32 is turned on, a clutch 23 for returning the exposure device is actuated by a relay contact 42*c* of the relay 42, which has been already energized, as shown in the time chart (o) in FIG. 3, so that the exposure device 17 starts a return movement by means of said driving wire 18. During this return movement, an original to be copied is exposed and scanned by the exposure lamps 19, which have already been turned on. When the exposure device 17 starts the return movement, the second exposure device detecting switch 21 is turned off, as shown in the time chart (e) in FIG. 3. The switch 21 is maintained off until it is actuated in the next copying operation in the same manner as mentioned above. The third switch 33 is again turned on by further rotation of the cam disc 30. The third switch 33 is maintained on until it is actuated in the next copying operation. When the exposure device 17 has returned to the start position, the first exposure device detecting switch 20 is again turned on, as shown in the time chart (d) in FIG. 3. At the same time, by a signal from the switch 20, the clutch 23 is turned off, so that the exposure device 17 is stopped, and the relay 42 is released from the self-latched condition, so that the exposure lamps 19 are turned off. When the relay contact 42*c* is turned off at the time the relay 42 is released, the transmission clutch 13 is actuated so as to drive the conveyor device 12, so that the exposed paper is conveyed to the developing device 15, and then, the paper is transported to the heating device 16 and discharged out of the apparatus. The cam disc 30 continues to rotate and actuates the first switch 31, so that it is turned off after the paper has been conveyed to a position where it does not hinder the next copying operation cycle. By turning the switch 31 off, the pilot lamp 39 is turned off. This indicates that the apparatus is ready for the next copying operation. Finally, the cam disc 30 actuates the second switch 32 so that it is turned off and stops at the original start position, which completes one revolution of the cam disc 30.

As mentioned above, the operational device which compose the electrographic copying apparatus are controlled so as to be actuated in a predetermined sequence with certainty, due to each of the operation signals which is emitted in respose to the preceding operation. The lighting timing of the exposure lamp is controlled so as to turn on the lamp only when the each switch is at the timing point A, B, C, D, in the time chart in FIG. 3, respectively. The interval from the time the switch 32 is turned off to the time it is turned on is adequately adjusted. With such a construction and function, the possibility of the occurrence of accidental lighting of the exposure lamp is very small.

A means for preventing the exposure lamp from being kept lit by accident will be discribed hereinafter with reference to FIGS. 4A and 4B. The accidental lighting of the exposure lamp will occur, for example, in a case when a lamp control element 36 (FIG. 2) for lighting the lamp is short-circuited, when, in the circuit of the clutch 23 for returning the exposure device, a wire is broken, or when the driving wire 18 of the exposure device is broken.

Figure 4A:
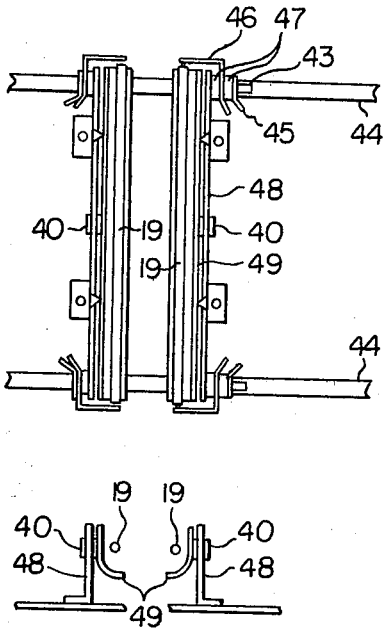
FIG. 4A is an enlarged view of a lamp attaching portion according to the present invention.
Figure 4B:
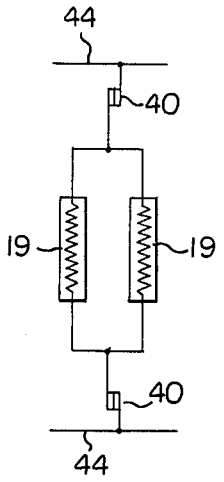
FIG. 4B illustrates an electric circuit of the lamp illustrated in FIG. 4A.

The lamp attaching portion of the exposure device is illustrated in FIG. 4A. Contacts 43, slide rails 44, contact terminals 45, lamp terminals 46, insulation plates 47, supports 48, reflecting plates 49 and thermal detectors 40 are illustrated in FIG. 4A. The contacts 43 slide with the exposure device along the slide rail 44. The contact terminal 45 of each contact 43 and each lamp terminal 46 are connected to each other with the insulation plate 47 interposed therebetween. This terminal assembly comprising the contact terminal 45 and the lamp terminal 46 is attached to the support 48 through the insulation plate 47. The reflecting plate 49 is installed on the support 48. The thermal detector 40 is directly mounted on the reflecting plate 49. As can be seen from FIG. 4B, each of the thermal detectors 40 is arranged in series with respect to all of the lamps 19. In such an arrangement, if one of the lamps 19 is kept lit by accident for a long time, the excessive increase of the lamp temperature is detected by the thermal detector which electrically interrupts the line connecting the power source and the lamps. Therefore, if the lamp temperature is excessively increased, all of the lamps 19 are turned off at the same time with certainty. Naturally, the thermal detector 40 does not actuate at the temperature of the lamp in normal operation.

In practical use, the thermal detector 40 is arranged so that it functions when the temperature of the reflecting plate 49 rises to about 65° C., so as to prevent the temperature of the glass plate on which an original paper is placed from exceeding 85° C. The temperature of the glass plate of 85° C. conforms to the law directed to the control of electric apparatus in Japan. In normal operation, the temperature of the reflecting plate 49 never rises to 65° C., if the exposure operation is continuously repeated, because there is a period in which the exposure lamps are turned off in one cycle of the exposure operation.

As mentioned above, in the exposure device of the electrographic copying apparatus according to the invention all of the exposure lamps are immediately turned off and thermal damage to the device is avoided, due to the arrangement of the thermal detector in series with respect to all of the exposure lamps.

Another embodiment of the present invention will now be described. This embodiment further comprises a means for controlling the exposure and for adjusting the uneveness of the exposure, in addition to the aforementioned means for avoiding an excessive increase of the exposure lamp temperature.

Figure 5:
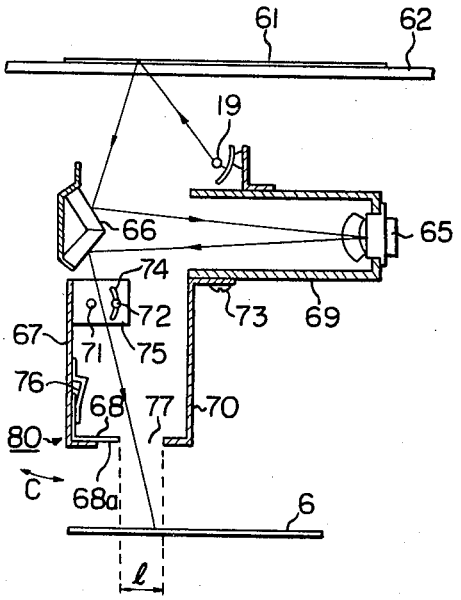
FIG. 5 is a schematic sectional side view of an exposure device according to the invention.

An example of the means for controlling the exposure and for adjusting the uneveness of the exposure is illustrated in FIG. 5. An exposure device is arranged between an original positioning plate 62, on which an original 61 is positioned, and a photosensitive paper 6. The exposure device comprises an exposure lamp 19, a mirror 66, an optical assembly 65, an exposure control means 80 and a frame 69 for mounting optical devices. A beam from the exposure lamp 19 lights the original 61 through the glass plate 62. The beam reflected by the original 61 is reflected by the mirror 66 and the optical assembly 65, and passes through a slit of the exposure control means 80. The beam, then, exposes the photosensitive paper 6. The exposure control means 80 comprises a stationary guide plate 70 fixed to the frame 69 by a screw means 73 and a movable guide plate 67. The slit 77 is formed between the lower end of the movable guide plate 67 and the lower end of the stationary guide plate 70. The slit 77 extends in a longitudinal direction perpendicular to the drawing. The movable guide plate 67 is rotatably mounted on a shaft 71 at the front side of the device (the fore side of the drawing) and at the rear side of the device (the back side of the drawing). A tongue 75 is attached to the movable guide plate 67 at its front portion. The tongue 75 has an arcuate groove 74 into which a fastening screw 72 is inserted. The movable guide plate 67 can be positioned at a desired position by rotating it about the shaft 71 and, then, tightening the screw 72. The screw 72 is arranged only in the front side tongue 75. A cover plate 68 is installed within the control means 80, sitting on the L-shaped end of the movable guide plate 67. An edge 68*a* of the cover plate 68 projects into the slit 77. The cover plate 68 is held stationary by a pressing plate 76 which resiliently presses the cover plate 68 toward the inside wall of the guide plate 67. The cover plate 68 can slide in the longitudinal direction and be drawn out of the control means 80.

In the operation of controlling the exposure, the screw 72 is loosened in the front side of the apparatus and the movable guide plate 67 is rotated about the shaft 71, as illustrated by an arrow C, so that the width (1) of the slit 77 can be adjusted to achieve a desirable exposure. At a desired portion, the guide plate 67 is fixed by tightening the screw 72.

In the operation of controlling the uneveness of the exposure, the cover plate 68 is drawn out toward the front side, and then, a desired portion of the edge 68*a* is cut off so as to avoid uneveness of the exposure. The cover plate 68 is, then, inserted into the exposure control means 80 along the lower edge of the guide plate 67.

As mentioned above, the construction of the control means for controlling the exposure and the uneveness of the exposure according to the present invention is very simple, so that the control operation is achieved easily and with certainty.

Figure 6:
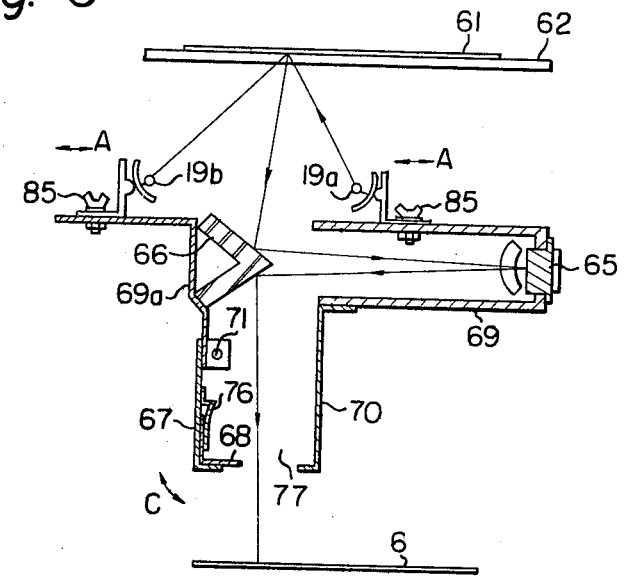
FIG. 6 is another schematic sectional side view of another embodiment of the exposure device according to the invention.
Figure 7:
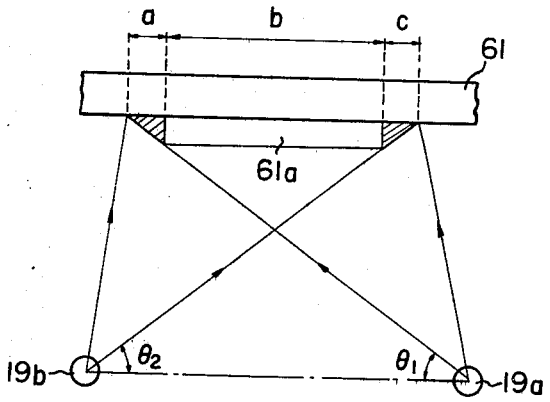
FIG. 7 is a sectional side view of a part of an original positioning plate according to the present invention for explaining positions of the exposure lamps illustrated in FIG. 6.

Another embodiment of the present invention is illustrated in FIGS. 6 and 7. In this embodiment the exposure device further comprises a means for removing a shade line appearing around an overlapped paper on an original, in addition to the aforementioned means for avoiding an excessive increase of the exposure lamp temperature. The same reference numerals are used in FIGS. 6 and 7 as in the FIG. 5 for parts which correspond in their function.

In this embodiment, an exposure device comprises two exposure lamps 19*a* and 19*b* for directing the light to a portion of an original 61, on the glass plate 62, obliquely from both sides of the portion. The exposure beam reflected by the original 61 is refected by a mirror 66 and an optical assembly 65, and passes through a slit 77 which extends in a direction perpendicular to the drawing. The beam, then, exposes a photosensitive paper 6. A stationary guide plate 70 is fixed to a frame 69 of the exposure device. A movable guide plate 67 is rotatably mounted on a shaft 71. The movable guide plate 67 can be rotated about the shaft 71, as shown by an arrow C, so as to adjust the width of the slit 77. A cover plate 68 is attached to the movable guide plate 67 by a pressing plate 76. The cover plate 68 can slide in the longitudinal direction of the guide plate 67. An edge of the cover plate 68 projects into the slit 77. Desired portions along the edge of the cover plate are cut off corresponding to the uneveness of the exposure, so as to avoid the uneveness of the exposure due to the uneveness of the luminous intensity of the exposure lamps or a specific characteristics of the lens of the optical assembly. Recesses (not shown) are formed in the frames 69 and 69*a* extending in the direction parallel to the plane of the drawing. Each of the exposure lamps 19*a*, 19*b* is mounted on the frame by means of a screw 85 which is inserted in the recess, so that each of the lamps can slide along the recess as shown by arrows A.

The arrangement of the exposure lamps 19*a*, 19*b* will be described hereinafter with reference to FIGS. 6 and 7.

A paper 61*a* is overlapped on an original 61. If the lamps 19*a* and 19*b* are arranged so that angles $\theta_1$ and $\theta_2$ (FIG. 7) are small, shade portions a and c are enlarged; while if the angles $\theta_1$ and $\theta_2$ are large, the shade portions a and c are small. However, if the angle $\theta_1$ and $\theta_2$ are excessively large, each of the exposure lamps 19*a*, 19*b* is positioned within the angle of view of the optical assembly 65, causing uneveness of the exposure. Therefore, the exposure lamp 19*a*, on the right side in FIG. 6, is preferably arranged at a position where the angle $\theta_1$ is maximized in the outer zone of the angle of view of the optical assembly 65. The other exposure lamp 19*b*, on the left side in FIG. 6, is preferably arranged at a position where the angle $\theta_2$ is maximized in the zone where the beam to the photosensitive paper 6 is interferred with by the cover plate 68 if the lamp is positioned within the angle of view of the optical assembly 65. This position of the exposure lamp 19*b* depends upon the position of the edge of the cover plate 68 which projects into the slit 77.

The overlapped paper 61*a* is lit from both sides thereof by the two exposure lamps 19*a* and 19*b*, in the above mentioned arrangement, so that the shade appearing around the edge of the paper due to its thickness, in the case of only one exposure lamp, disappears because of the light beam from the other exposure lamp. Therefore, the shade line does not appear on the photosensitive paper. Consequently, when copying an original with another original overlapped thereon, a clear copy which does not have an image of the shade line is obtained, without manually erasing the shade line from the copied paper. This is especially advantageous in making a single drawing from a combination of two or more drawings, by copying an original drawing on which parts of other drawings are overlapped. Especially, in a photoengraving process, a plate making process is easily achieved because the shade line erasing process is needless.

As mentioned hereinbefore, the exposure device according to the present invention increases the reliability and usefulness of the known electrographic copying apparatus. The functional value of the known electrographical copying apparatus is enhanced by using an exposure device which comprises the means for avoiding excessive temperature increase of the exposure lamps, described with reference to FIGS. 1 through 4B, the means for controlling the exposure and the uneveness of the exposure, described with reference to FIG. 5, and also, the means for removing the shade line of an overlapped paper on the original.

The present invention is not limited to the embodiments hereindescribed with reference to the accompanying drawings, but can be modified into many variations thereof within the scope of the claims.

What is claimed is:

1. An exposure device of an electrographic copying apparatus which comprises at least one heat generative exposure lamp for creating an electrostatic latent image on a photosensitive paper corresponding to an original to be copied, wherein the device comprises:

paper detector means for detecting said photosensitive paper when it is fed from a paper case to a paper feed device;

an exposure device disposed above said paper feed device and reciprocally movable with said exposure lamp;

exposure device detector means for detecting said exposure device at its start position;

cam means which is rotated by a drive means through a clutch means when said paper detector means detects the rear end of said paper, said cam means comprising a first switch which represents an initial condition, second and third switches which represent an exposure start condition; and exposure lamp control means comprising a relay means which is self-latched when said paper detector means and said exposure device detector means are turned off, and when said second and third switches are turned off and said relay remains latched until said exposure device detector means detects the start position, said exposure lamp being turned on during the time said relay means is operated.

2. An exposure device of an electrographic copying apparatus according to claim 1, wherein the device further comprises at least one thermal detector connected in series to all of said exposure lamps, for turning said exposure lamps off when the temperature of a portion of the exposure device excessively increases.

3. An exposure device of an electrographic copying apparatus according to claim 1, wherein the device further comprises a means for controlling the exposure and the uneveness of the exposure comprising:

a movable guide plate rotatably mounted on a shaft, for adjusting the width of a slit through which the exposure beam passes;

a means for fixing said movable guide plate, and;

a cover plate for covering a part of said slit arranged on said movable guide plate so that it can slide along the longitudinal direction of said movable guide plate and that the edge thereof projects into said slit.

4. An exposure device of an electrographic copying apparatus according to claim 1, further comprising:

a movable guide plate rotatably mounted on a shaft for adjusting the width of a slit through which the exposure beam passes, and;

a cover plate for covering a part of said slit arranged on said movable guide plate, so that the edge of said cover plate projects into said slit, wherein the device comprises two exposure lamps for directing the light to a portion of an original obliquely from both sides of the portion, at least one of said two exposure lamps being arranged so that the position thereof is adjustable so that the position of the lamp can be made to correspond to the position of said edge of said cover plate.

* * * * *